US011279899B2

(12) United States Patent
Kusakai et al.

(10) Patent No.: US 11,279,899 B2
(45) Date of Patent: Mar. 22, 2022

(54) GREASE COMPOSITION FOR A CONSTANT-VELOCITY JOINT

(71) Applicants: Honda Motor Co., Ltd., Tokyo (JP); ENEOS Corporation, Tokyo (JP)

(72) Inventors: Katsuhito Kusakai, Tokyo (JP); Yasuo Suzuki, Tokyo (JP); Kazuya Matsuoka, Tokyo (JP); Toru Izumi, Tokyo (JP); Yusuke Ayame, Tokyo (JP)

(73) Assignees: HONDA MOTOR CO., LTD., Tokyo (JP); ENEOS CORPORATION, Tokyo (JP)

( * ) Notice: Subject to any disclaimer, the term of this patent is extended or adjusted under 35 U.S.C. 154(b) by 0 days.

(21) Appl. No.: 17/218,252

(22) Filed: Mar. 31, 2021

(65) Prior Publication Data

US 2021/0340459 A1 Nov. 4, 2021

(30) Foreign Application Priority Data

Mar. 31, 2020 (JP) ..... JP2020-063173

(51) Int. Cl.

| | |
|---|---|
| ***C10M 173/02*** | (2006.01) |
| ***C10M 169/06*** | (2006.01) |
| ***C10M 115/04*** | (2006.01) |
| ***C10M 115/08*** | (2006.01) |
| ***C10M 125/26*** | (2006.01) |
| ***C10M 135/18*** | (2006.01) |
| ***C10M 137/10*** | (2006.01) |
| ***C10M 101/02*** | (2006.01) |
| *C10N 50/10* | (2006.01) |
| *C10N 10/04* | (2006.01) |
| *C10N 10/12* | (2006.01) |

(52) U.S. Cl.

CPC ..... *C10M 169/06* (2013.01); *C10M 101/02* (2013.01); *C10M 115/04* (2013.01); *C10M 115/08* (2013.01); *C10M 125/26* (2013.01); *C10M 135/18* (2013.01); *C10M 137/10* (2013.01); *C10M 2201/087* (2013.01); *C10M 2203/1006* (2013.01); *C10M 2207/0206* (2013.01); *C10M 2215/044* (2013.01); *C10M 2215/14* (2013.01); *C10M 2219/066* (2013.01); *C10M 2223/045* (2013.01); *C10N 2010/04* (2013.01); *C10N 2010/12* (2013.01); *C10N 2050/10* (2013.01)

(58) Field of Classification Search

CPC ..... C10M 169/06; C10M 115/08; C10M 135/18; C10M 125/26; C10M 115/04; C10M 137/10; C10M 2201/087; C10M 2215/14; C10M 2215/044; C10M 2219/066; C10M 2223/045; C10N 2010/04; C10N 2050/10; C10N 2010/12

USPC ..... 508/156

See application file for complete search history.

(56) References Cited

U.S. PATENT DOCUMENTS

2007/0298890 A1* 12/2007 Momiyama ..... F16D 3/845 464/147

FOREIGN PATENT DOCUMENTS

| | | |
|---|---|---|
| CA | 1332936 C | 11/1994 |
| JP | H02-20597 | 1/1990 |

* cited by examiner

*Primary Examiner* — Prem G Singh
*Assistant Examiner* — Francis C Campanell
(74) *Attorney, Agent, or Firm* — Greenblum & Bernstein, P.L.C.

(57) ABSTRACT

A grease composition for a constant-velocity joint includes a mineral oil, a thickener, a molybdenum dithiocarbamate, a potassium borate hydrate, and a zinc dialkyldithiophosphate, wherein a content of the molybdenum dithiocarbamate is 1.2% by mass or more and 8% by mass or less, a content of the zinc dialkyldithiophosphate is 0.3% by mass or more and 2.0% by mass or less, and a content of the potassium borate hydrate is 0.28% by mass or more and 1.9% by mass or less, and wherein a mass ratio of the content of the molybdenum dithiocarbamate to the content of the potassium borate hydrate (molybdenum dithiocarbamate/potassium borate hydrate) is 2 or more and 13 or less, and a mass ratio of the content of the zinc dialkyldithiophosphate to the content of the potassium borate hydrate (zinc dialkyldithiophosphate/potassium borate hydrate) is 0.5 or more and 3.6 or less.

7 Claims, No Drawings

GREASE COMPOSITION FOR A CONSTANT-VELOCITY JOINT

TECHNICAL FIELD

The present invention relates to a grease composition for a constant-velocity joint.

BACKGROUND ART

A constant-velocity joint means a joint that smoothly transmits a power without rotational fluctuation when the input shaft and the output shaft rotate at any angles (operating angles). Constant-velocity joints are widely used in automobiles and various industrial machines. In an automobile, constant-velocity joints are mainly used in drive shafts which connect a transmission to a tire.

In a constant-velocity joint, a lubricant, preferably a grease is filled for the purpose of reducing the coefficient of friction, for example. In recent years, urea-based greases or urea-urethane greases containing various additives have been used to increase the performance of constant-velocity joints. There also is a grease for constant-velocity joints in which an alkali metal borate hydrate, a molybdenum compound, and a sulfur-phosphorus based extreme-pressure agent are added as additives and which provides low wear (Patent Document 1).

CITATION LIST

Patent Literature

Patent Document 1: JP-A-2-20597

SUMMARY OF INVENTION

Technical Problem

The present inventors have found that a grease composition for constant-velocity joints in which an alkali metal borate hydrate, a molybdenum compound, and a sulfur-phosphorus based extreme-pressure agent are added as additives sometimes causes poor lubrication, when the input shaft and the output shaft of a constant-velocity joint are at a high angle (high surface pressure). Poor lubrication may lead to malfunction and trouble of instruments.

Solution to Problem

The present inventors have made intensive and extensive studies on a method for preventing a grease composition for constant-velocity joints in which an alkali metal borate hydrate, a molybdenum compound, and a sulfur-phosphorus based extreme-pressure agent are added as additives from causing poor lubrication when the input shaft and the output shaft of a constant-velocity joint are at a high angle (high surface pressure). Thus, the present inventors have found that the above problem can be solved when the contents of the three components and the ratio thereof are within specific ranges, completing the present invention.

The present inventors have found that the above problem is not sufficiently solved only by blending a molybdenum dithiocarbamate, a potassium borate hydrate, and a zinc dialkyldithiophosphate in specific content ranges and the lubrication at a high surface pressure is deteriorated unless the ratio of the three components is within a specific range. In other words, the present inventors have found that the lubrication at a high surface pressure can be improved when the ratio of the three components is within a specific range.

The present invention has been made based on the findings and is as follows.

<1> A grease composition for constant-velocity joints, the grease composition containing
a mineral oil,
a thickener,
a molybdenum dithiocarbamate,
a potassium borate hydrate, and
a zinc dialkyldithiophosphate,
the grease composition having
a content of the molybdenum dithiocarbamate based on the total amount of the grease composition of 1.2% by mass or more and 8% by mass or less,
a content of the zinc dialkyldithiophosphate based on the total amount of the grease composition of 0.3% by mass or more and 2.0% by mass or less,
a content of the potassium borate hydrate based on the total amount of the grease composition of 0.28% by mass or more and 1.9% by mass or less,
a mass ratio of the content of the molybdenum dithiocarbamate to the content of the potassium borate hydrate (molybdenum dithiocarbamate/potassium borate hydrate) of 2 or more and 13 or less, and
a mass ratio of the content of the zinc dialkyldithiophosphate to the content of the potassium borate hydrate (zinc dialkyldithiophosphate/potassium borate hydrate) of 0.5 or more and 3.6 or less.

<2> The grease composition for constant-velocity joints according to <1>, wherein the grease composition has a mass ratio of the content of the molybdenum dithiocarbamate to the content of the zinc dialkyldithiophosphate (molybdenum dithiocarbamate/zinc dialkyldithiophosphate) of 3 or more.

<3> The grease composition for constant-velocity joints according to <1> or <2>, wherein
the mass ratio of the content of the molybdenum dithiocarbamate to the content of the potassium borate hydrate (molybdenum dithiocarbamate/potassium borate hydrate) is 2 or more and 8 or less, and
the mass ratio of the content of the zinc dialkyldithiophosphate to the content of the potassium borate hydrate (zinc dialkyldithiophosphate/potassium borate hydrate) is 0.7 or more and 3.6 or less.

<4> The grease composition for constant-velocity joints according to any one of <1> to <3>, wherein the grease composition has
a content of the mineral oil based on the total amount of the grease composition of 50% by mass or more and 90% by mass or less, and
a content of the thickener based on the total amount of the grease composition of 2% by mass or more and 30% by mass or less.

Advantageous Effects of Invention

The grease composition for a constant-velocity joint of the present invention can improve lubrication of a constant-velocity joint at a high angle (high surface pressure).

DESCRIPTION OF EMBODIMENTS

[1. Grease Composition]

[Lubricant Base Oil]

In the grease composition for a constant-velocity joint of the present invention, a mineral oil is used as a lubricant base oil. The mineral oil preferably has a kinetic viscosity at 40° C. of 1 to 500 $mm^2/s$, and more preferably 100 to 200 $mm^2/s$. The kinetic viscosity, as used herein, refers to a value measured according to JIS K 2283:2000.

As the mineral oil, a fraction obtained by distilling crude oil under a normal pressure can be used. Also, a fraction obtained by distilling crude oil under a normal pressure is further subjected to distillation under a reduced pressure, and the thus obtained distillate is then refined by various refining processes, thereby obtaining the lubricant fraction. Examples of the refining processes include hydrogenation refining, solvent extraction, solvent dewaxing, hydrogenation dewaxing, sulfuric acid washing, and clay treatment. The mineral oil for use in the present invention can be obtained by a treatment with any combination of the refining processes in any appropriate order. A mixture of two or more refined oils having different properties which are obtained by treating different crude or distillates with different combinations and orders of processes can also be used.

The mineral oils mentioned above can be used alone or in mixture of two or more thereof as a lubricant base oil.

The content of the mineral oil based on the total amount of the grease composition is preferably 50% by mass or more and 90% by mass or less, and particularly preferably 60% by mass or more and 90% by mass or less. With a content of the lubricant base oil in the range of 50% by mass or more and 90% by mass or less, a grease composition having a desired consistency can be easily prepared.

[Thickener]

As a thickener for use in the grease composition for a constant-velocity joint of the present invention, any thickener used in a general grease composition can be used without any trouble. Among them, a metal soap-based thickener and a urea-based thickener are preferably used. One of the thickeners may be used alone or two or more thereof may be used in mixture. The thickener may be used in any content as long as a desired consistency is obtained, and, for example, the content based on the total amount of the grease composition is preferably 2% by mass or more and 30% by mass or less, and further preferably 4% by mass or more and 15% by mass or less.

Among them, the metal soap-based thickener is a thickener containing a metal salt of a carboxylic acid. The carboxylic acid may be a carboxylic acid derivative having a hydroxy group or the like.

As the carboxylic acid, an aliphatic carboxylic acid, such as stearic acid or azelaic acid, an aromatic carboxylic acid, such as terephthalic acid, or the like may be used. In particular, a monobasic aliphatic carboxylic acid having 12 to 20 carbon atoms or a dibasic aliphatic carboxylic acid having 6 to 14 carbon atoms is preferred, and a monobasic aliphatic carboxylic acid which has one hydroxy group is more preferred.

When the description of "having 12 to 20 carbon atoms" is used herein, the end values, that is, 12 and 20 are included in the range.

As the metal, an alkali metal, such as lithium or sodium, an alkaline earth metal, such as calcium, or an amphoteric metal, such as aluminum, may be used, and an alkali metal, particularly lithium, is preferred.

The thickener may be incorporated in the form of metal soap. A carboxylic acid and a metal source (metal salt, metal salt hydroxide, etc.) may be separately incorporated so that the carboxylic acid and the metal source are reacted to form a metal soap thickener in preparation of the grease composition.

As the urea-based thickener, for example, a diurea compound obtained by a reaction of a diisocyanate and a monoamine, a polyurea compound obtained by a reaction of a diisocyanate and a monoamine or diamine, a urea-urethane compound obtained by a reaction of a diisocyanate, a primary amine, and a higher alcohol represented by the general formula R1-OH, a diurethane compound obtained by a reaction of a diisocyanate and a higher alcohol, or the like can be used.

Monoamine refers to a compound that has one amino group in one molecule. Preferred examples of primary amines include octylamine, dodecylamine, hexadecylamine, stearylamine, oleylamine, aniline, p-toluidine, and cyclohexylamine. Preferred examples of secondary amines include dicyclohexylamine.

Diamine refers to a compound that has two amino groups in one molecule. Preferred examples of diamines include ethylenediamine, propanediamine, butanediamine, hexanediamine, octanediamine, phenylenediamine, tolylenediamine, xylenediamine, and diaminodiphenylmethane. The hydrocarbon groups in the monoamine and diamine may each be an acyclic hydrocarbon or a cyclic hydrocarbon, and examples thereof include an aromatic hydrocarbon, an alicyclic hydrocarbon, and an aliphatic hydrocarbon. The carbon number thereof is preferably 2 to 20, and particularly preferably 4 to 18.

The diisocyanate refers to a compound in which two hydrogen atoms in a hydrocarbon are each substituted with an isocyanate group, and preferred examples thereof include phenylene diisocyanate, tolylene diisocyanate, diphenyl diisocyanate, diphenylmethane diisocyanate, octadecane diisocyanate, decane diisocyanate, and hexane diisocyanate. The hydrocarbon may be an acyclic hydrocarbon or a cyclic hydrocarbon, and examples thereof include an aromatic hydrocarbon, an alicyclic hydrocarbon, and an aliphatic hydrocarbon. The carbon number thereof is preferably 4 to 20, and particularly preferably 8 to 18.

In the grease composition for a constant-velocity joint of the present invention, specifically, urea-based thickeners represented by the following general formulae (1) to (3) can be used.

Formula (1)

[Chem. 1]

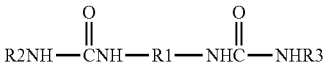

Formula (2)

[Chem. 2]

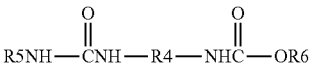

Formula (3)

[Chem. 3]

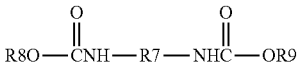

In the formulae (1) to (3), R1, R4, and R7 may be the same as or different from one another, and each represent a divalent aromatic hydrocarbon group having 6 to 15 carbon atoms.

In the formulae (1) to (3), R2, R3, and R5 may be the same as or different from one another, and each represent a cyclohexyl group or a cyclohexyl derivative group having 7 to 12 carbon atoms. Specific examples of R2, R3, and R5 include a cyclohexyl group, a methylcyclohexyl group, a dimethylcyclohexyl group, an ethylcyclohexyl group, a diethylcyclohexyl group, a propylcyclohexyl group, an isopropylcyclohexyl group, a 1-methyl-3-propylcyclohexyl group, a butylcyclohexyl group, an amylcyclohexyl group, an amylmethylcyclohexyl group, and a hexylcyclohexyl group. Particularly preferred examples thereof include a cyclohexyl group, and a cyclohexyl derivative group having 7 to 8 carbon atoms, for example, a methylcyclohexyl group, a dimethylcyclohexyl group, and an ethylcyclohexyl group.

In the formulae (2) to (3), R6, R8, and R9 may be the same as or different from each other, and each represent an alkyl group or alkenyl group having 8 to 20 carbon atoms. Specific examples of R6, R8, and R9 include those having a linear structure or a branched structure represented by an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, an eicosyl group, an octenyl group, a nonenyl group, a decenyl group, an undecenyl group, a dodecenyl group, a tridecenyl group, a tetradecenyl group, a pentadecenyl group, a hexadecenyl group, a heptadecenyl group, an octadecenyl group, a nonadecenyl group, or an eicosenyl group. Particularly preferred examples thereof include an alkyl group or alkenyl group having 16 to 19 carbon atoms, for example, a hexadecyl group, a heptadecyl group, an octadecyl group, a nonadecyl group, a hexadecenyl group, a heptadecenyl group, an octadecenyl group, and a nonadecenyl group.

[Potassium Borate Hydrate]

The potassium borate hydrate used in the grease composition for constant-velocity a joint of the present invention is a hydrous complex oxide of potassium and boron.

The general formula is represented by $K_2O.xB_2O_3.yH_2O$ (wherein x=0.5 to 5.0, y=1.0 to 5.0). The potassium borate hydrate preferably has an average particle size of 1 μm or less, and more preferably 0.5 μm or less.

The content of the potassium borate hydrate in the grease composition for a constant-velocity joint of the present invention is 0.28% by mass or more and 1.9% by mass or less based on the total amount of the grease composition. The content of the potassium borate hydrate in the grease composition for a constant-velocity joint of the present invention is preferably 0.4% by mass or more and 1.6% by mass or less, more preferably 0.6% by mass or more and 1.4% by mass or less, and further preferably 0.8% by mass or more and 1.2% by mass or less.

[Molybdenum dithiocarbamate]

As used herein, the "molybdenum dithiocarbamate" refers to a compound represented by the following formula (4).

Formula (4)

[Chem. 4]

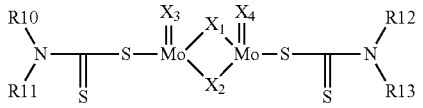

(In the formula, R10 to 13 may be the same as or different from one another, and each represent a hydrocarbon group having 1 to 24 carbon atoms. $X_1$ to $X_4$ may be the same as or different from one another, and each represent S or O.)

The molybdenum dithiocarbamate is herein sometimes referred to simply as MoDTC. The content of the molybdenum element in the MoDTC is preferably 10 to 40% by mass, and more preferably 20 to 35% by mass.

The content of the MoDTC in the grease composition for a constant-velocity joint of the present invention is 1.2% by mass or more and 8% by mass or less based on the total amount of the grease composition. The content of the MoDTC in the grease composition for a constant-velocity joint of the present invention is preferably 2% by mass or more and 7% by mass or less, more preferably 3% by mass or more and 6% by mass or less, and further preferably 4% by mass or more and 5.5% by mass or less.

When the content of the MoDTC is the lower limit or more, the coefficient of friction can be suppressed low.

Even with a content more than the upper limit, the effect is not varied.

[Zinc dialkyldithiophosphate]

An example of the zinc dialkyldithiophosphate used in the grease composition for a constant-velocity joint of the present invention is a compound represented by the following general formula (5).

Formula (5)

[Chem. 5]

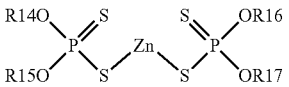

(In the formula (5), R14 to R17 each represent a hydrocarbon group having 1 to 24 carbon atoms. The hydrocarbon group having 1 to 24 carbon atoms is preferably a linear or branched alkyl group having 1 to 24 carbon atoms. The carbon number is preferably 3 or more and preferably 12 or less, and further preferably 8 or less. The alkyl group may be primary, secondary, or tertiary, and primary, secondary, or mixture of primary and secondary is preferred, and secondary is most preferred.)

The zinc dialkyldithiophosphate is herein sometimes referred to simply as ZnDTP.

The content of the ZnDTP in the grease composition for a constant-velocity joint of the present invention is 0.3% by mass or more and 2.0% by mass or less based on the total amount of the grease composition. The content of the ZnDTP in the grease composition for constant-velocity joints of the present invention is preferably 0.4% by mass or more and 1.8% by mass or less, more preferably 0.6% by mass or more and 1.6% by mass or less, and further preferably 0.8% by mass or more and 1.4% by mass or less.

[Mass Ratio of MoDTC to potassium borate hydrate]

The grease composition for a constant-velocity joint of the present invention has a mass ratio of the content of the molybdenum dithiocarbamate to the content of the potassium borate hydrate (molybdenum dithiocarbamate/potassium borate hydrate) of 2 or more and 13 or less. Within this range, excellent lubrication performance can be obtained in a constant-velocity joint at a high surface pressure. The mass ratio of the content of the molybdenum dithiocarbamate to the content of the potassium borate hydrate is preferably 2 or more and 8 or less, more preferably 2.5 or more and 7 or less, further preferably 3 or more 6 or less, and most preferably 4 or more and 5 or less.

[Mass Ratio of ZnDTP to potassium borate hydrate]

The grease composition for a constant-velocity joint of the present invention has a mass ratio of the content of the zinc dialkyldithiophosphate to the content of the potassium borate hydrate (zinc dialkyldithiophosphate/potassium borate hydrate) of 0.5 or more and 3.6 or less. Within this range, excellent lubrication performance can be obtained in a constant-velocity joint at a high surface pressure. The mass ratio of the content of the zinc dialkyldithiophosphate to the content of the potassium borate hydrate is preferably 0.7 or more and 3.2 or less, more preferably 0.7 or more and 2.5 or less, and further preferably 0.8 or more and 1.8 or less.

(Mass Ratio of MoDTC to ZnDTP)

The grease composition for a constant-velocity joint of the present invention preferably has amass ratio of the content of the molybdenum dithiocarbamate to the content of the zinc dialkyldithiophosphate (molybdenum dithiocarbamate/zinc dialkyldithiophosphate) of 3 or more 10 or less. With a mass ratio of 3 or more, excellent lubrication performance can be obtained in a constant-velocity joint at a high surface pressure. The mass ratio of the content of the molybdenum dithiocarbamate to the content of the zinc dialkyldithiophosphate is preferably 3.2 or more and 8 or less, more preferably 3.5 or more and 6 or less, and further preferably 3.8 or more and 4.6 or less.

[Other Additives]

To the grease composition for a constant-velocity joint of the present invention, besides the above components, an antioxidant, an antirust agent, a cleaning agent, a dispersant, an anti-wear agent, an extreme-pressure agent, a viscosity index improver, a corrosion inhibitor, and the like which are generally used in a lubricant or grease can be appropriately added, as required.

EXAMPLES

Example 1

The present invention will be described below with reference to examples. The present invention is not to be limited to the following embodiments. Unless otherwise described, % represents % by mass.

<Formulation of Grease Composition>

For Examples and Comparative Examples, a thickener, a base oil, and additives were blended according to the formulations shown in Tables 1 to 4 to prepare test grease compositions. The test grease compositions were subjected to the evaluations described below.

(1) Base oil

A mineral oil having a kinetic viscosity at 40° C. of 175 $mm^2/s$ was used.

(2) Thickener (raw material)

Diphenylmethane-4,4'-diisocyanate

Alicyclic amine (cyclohexyl amine)

Higher alcohol (stearyl alcohol)

An alicyclic amine and a higher alcohol were reacted with a diisocyanate compound (methylene diisocyanate) in the ratio shown in Tables 1 to 4 to prepare a urea-urethane compound.

(3) Additive

Additives were added as shown in Tables 1 to 4. The details of the additives were as follows. Tables 5 and 6 show relations between the mass ratios of the components and the evaluation results in Examples and Comparative Examples.

Polysulfide: Anglamol 33 (product name) manufactured by The Lubrizol Corporation Calcium sulfonate: HYBASE C500 (product name) manufactured by LANXESS Potassium borate hydrate: OLOA 9750 (product name) manufactured by Chevron Oronite Company LLC ZnDTP: HiTEC-1656 (product name) manufactured by Afton Chemical Corporation MoDTC: ADEKA SAKURA-LUBE 600 (product name) manufactured by ADEKA CORPORATION

TABLE 1

| Raw material | | Unit | Example 1 | Example 2 | Comparative Example 1 | Comparative Example 2 |
|---|---|---|---|---|---|---|
| Base oil | Mineral oil | % by mass | Balance | Balance | Balance | Balance |
| Thickener | Diphenylmethane-4,4'-diisocyanate | % by mass | 3.39 | 3.39 | 3.39 | 3.39 |
| | Cyclohexylamine | % by mass | 2.15 | 2.15 | 2.15 | 2.15 |
| | Stearyl alcohol | % by mass | 1.46 | 1.46 | 1.46 | 1.46 |
| Additive | Polysulfide | % by mass | 1.00 | 1.00 | 1.00 | 1.00 |
| | Calcium sulfonate | % by mass | 0.30 | 0.30 | 0.30 | 0.30 |
| | Potassium borate hydrate | % by mass | 0.38 | 0.75 | 1.13 | 1.50 |
| | ZnDTP | % by mass | 0.40 | 0.40 | 0.40 | 0.40 |
| | MoDTC | % by mass | 1.60 | 1.60 | 1.60 | 1.60 |
| Evaluation result | | GPa | — | — | 4.6 | 4.3 |

TABLE 2

| Raw material | | Unit | Example 3 | Example 4 |
|---|---|---|---|---|
| Base oil | Mineral oil | % by mass | Balance | Balance |
| Thickener | Diphenylmethane-4,4'-diisocyanate | % by mass | 3.39 | 3.39 |
| | Cyclohexylamine | % by mass | 2.15 | 2.15 |
| | Stearyl alcohol | % by mass | 1.46 | 1.46 |
| Additive | Polysulfide | % by mass | 1.00 | 1.00 |
| | Calcium sulfonate | % by mass | 0.30 | 0.30 |
| | Potassium borate hydrate | % by mass | 0.38 | 0.75 |
| | ZnDTP | % by mass | 0.80 | 0.80 |
| | MoDTC | % by mass | 3.20 | 3.20 |
| Evaluation result | | GPa | — | — |

TABLE 3

| Raw material | | Unit | Example 5 | Example 6 | Example 7 | Example 8 |
|---|---|---|---|---|---|---|
| Base oil | Mineral oil | % by mass | Balance | Balance | Balance | Balance |
| Thickener | Diphenylmethane-4,4'-diisocyanate | % by mass | 3.39 | 3.39 | 3.39 | 3.39 |
| | Cyclohexylamine | % by mass | 2.15 | 2.15 | 2.15 | 2.15 |
| | Stearyl alcohol | % by mass | 1.46 | 1.46 | 1.46 | 1.46 |
| Additive | Polysulfide | % by mass | 1.00 | 1.00 | 1.00 | 1.00 |
| | Calcium sulfonate | % by mass | 0.30 | 0.30 | 0.30 | 0.30 |
| | Potassium borate hydrate | % by mass | 0.38 | 0.75 | 1.13 | 1.50 |
| | ZnDTP | % by mass | 1.20 | 1.20 | 1.20 | 1.20 |
| | MoDTC | % by mass | 4.80 | 4.80 | 4.80 | 4.80 |
| Evaluation result | | GPa | — | — | — | — |

TABLE 4

| Raw material | | Unit | Comparative Example 3 | Example 9 | Example 10 |
|---|---|---|---|---|---|
| Base oil | Mineral oil | % by mass | Balance | Balance | Balance |
| Thickener | Diphenylmethane-4,4'-diisocyanate | % by mass | 3.39 | 3.39 | 3.39 |
| | Cyclohexylamine | % by mass | 2.15 | 2.15 | 2.15 |
| | Stearyl alcohol | % by mass | 1.46 | 1.46 | 1.46 |
| Additive | Polysulfide | % by mass | 1.00 | 1.00 | 1.00 |
| | Calcium sulfonate | % by mass | 0.30 | 0.30 | 0.30 |
| | Potassium borate hydrate | % by mass | 0.38 | 1.13 | 1.50 |
| | ZnDTP | % by mass | 1.60 | 1.60 | 1.60 |
| | MoDTC | % by mass | 6.40 | 6.40 | 6.40 |
| Evaluation result | | GPa | 3.9 | — | — |

ball (diameter: 10 mm)/plate. After a running-in operation with a load of 50 N for 10 minutes, a load of 100 N was applied for 10 minutes, followed by a load of 200 N for 10 minutes. The load was finally increased to 1000 N, and the presence of poor lubrication was checked. The evaluation results are shown in Tables 1 to 4.

The "-" in the evaluation results means that no poor lubrication was caused. The numerical values in the evaluation results represent the maximum contact surface pressures when the coefficient of friction exceeded 0.15. The constant-velocity joints containing the grease compositions of Examples 1 to 10 did not cause poor lubrication even in the state of a high surface pressure. On the other hand, the constant-velocity joints containing the grease compositions of Comparative Example 1 to 3 caused poor lubrication at a maximum contact surface pressure of 3.9 GPa to 4.6 GPa.

TABLE 5

| | Example 1 | Example 2 | Comparative Example 1 | Comparative Example 2 | Example 3 | Example 4 | Example 5 |
|---|---|---|---|---|---|---|---|
| MoDTC/potassium borate hydrate | 4.2 | 2.1 | 1.4 | 1.1 | 8.4 | 4.3 | 12.6 |
| ZnDTP/potassium borate hydrate | 1.1 | 0.5 | 0.4 | 0.3 | 2.1 | 1.1 | 3.2 |
| MoDTC/ZnDTP | 4.0 | 4.0 | 4.0 | 4.0 | 4.0 | 4.0 | 4.0 |
| Evaluation result | — | — | 4.6 | 4.3 | — | — | — |

TABLE 6

| | Example 6 | Example 7 | Example 8 | Comparative Example 3 | Example 9 | Example 10 |
|---|---|---|---|---|---|---|
| MoDTC/potassium borate hydrate | 6.4 | 4.2 | 3.2 | 16.8 | 5.7 | 4.3 |
| ZnDTP/potassium borate hydrate | 1.6 | 1.1 | 0.8 | 4.2 | 1.4 | 1.1 |
| MoDTC/ZnDTP | 4.0 | 4.0 | 4.0 | 4.0 | 4.0 | 4.0 |
| Evaluation result | — | — | — | 3.9 | — | — |

<Evaluation>

The coefficient of friction was measured according to ASTM D5707 under conditions of 6 Hz, ±1 mm, 40° C., and

INDUSTRIAL APPLICABILITY

The grease composition for a constant-velocity joint of the present invention can improve lubrication of the constant-velocity joint at a high angle (high surface pressure).

The invention claimed is:

1. A grease composition for a constant-velocity joint, the grease composition comprising:

a mineral oil, a thickener, a molybdenum dithiocarbamate, a potassium borate hydrate, and a zinc dialkyldithiophosphate, wherein a content of the molybdenum dithiocarbamate based on a total amount of the grease composition is 1.2% by mass or more and 8% by mass or less, a content of the zinc dialkyldithiophosphate based on the total amount of the grease composition is 0.3% by mass or more and 2.0% by mass or less, and a content of the potassium borate hydrate based on the total amount of the grease composition is 0.28% by mass or more and 1.9% by mass or less, and wherein a mass ratio of the content of the molybdenum dithiocarbamate to the content of the potassium borate hydrate (molybdenum dithiocarbamate/potassium borate hydrate) is 2 or more and 13 or less, a mass ratio of the content of the zinc dialkyldithiophosphate to the content of the potassium borate hydrate (zinc dialkyldithiophosphate/potassium borate hydrate) is 0.5 or more and 3.6 or less, a mass ratio of the content of the molybdenum dithiocarbamate to the content of the zinc dialkyldithiophosphate (molybdenum dithiocarbamate/zinc dialkyldithiophosphate) is 3 or more, and the thickener is a urea-based thickener represented by a formula (2):

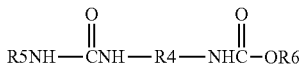

in the formula (2), R4 represents a divalent aromatic hydrocarbon group having 6 to 15 carbon atoms, R5 represents a cyclohexyl group or a cyclohexyl derivative group having 7 to 12 carbon atoms, and R6 represents an alkyl group or alkenyl group having 8 to 20 carbon atoms.

2. The grease composition for a constant-velocity joint according to claim 1, wherein the mass ratio of the content of the molybdenum dithiocarbamate to the content of the potassium borate hydrate (molybdenum dithiocarbamate/potassium borate hydrate) is 2 or more and 8 or less, and the mass ratio of the content of the zinc dialkyldithiophosphate to the content of the potassium borate hydrate (zinc dialkyldithiophosphate/potassium borate hydrate) is 0.7 or more and 3.6 or less.

3. The grease composition for a constant-velocity joint according to claim 1, wherein a content of the mineral oil based on the total amount of the grease composition is 50% by mass or more and 90% by mass or less, and a content of the thickener based on the total amount of the grease composition is 2% by mass or more and 30% by mass or less.

4. The grease composition for a constant-velocity joint according to claim 1, wherein the mass ratio of the content of the molybdenum dithiocarbamate to the content of the potassium borate hydrate (molybdenum dithiocarbamate/potassium borate hydrate) is 2 or more and 8 or less, and the mass ratio of the content of the zinc dialkyldithiophosphate to the content of the potassium borate hydrate (zinc dialkyldithiophosphate/potassium borate hydrate) is 0.7 or more and 3.6 or less.

5. The grease composition for a constant-velocity joint according to claim 1, wherein a content of the mineral oil based on the total amount of the grease composition is 50% by mass or more and 90% by mass or less, and a content of the thickener based on the total amount of the grease composition is 2% by mass or more and 30% by mass or less.

6. The grease composition for a constant-velocity joint according to claim 2, wherein a content of the mineral oil based on the total amount of the grease composition is 50% by mass or more and 90% by mass or less, and a content of the thickener based on the total amount of the grease composition is 2% by mass or more and 30% by mass or less.

7. The grease composition for a constant-velocity joint according to claim 4, wherein a content of the mineral oil based on the total amount of the grease composition is 50% by mass or more and 90% by mass or less, and a content of the thickener based on the total amount of the grease composition is 2% by mass or more and 30% by mass or less.

* * * * *